United States Patent [19]

Eisses

[11] 4,303,199

[45] Dec. 1, 1981

[54] RESTORED VIBRATION ISOLATION FOR RAILWAY TRACKS

[76] Inventor: Jacobus A. Eisses, Haydenlaan 4, 3723 KH Bilthoven, Netherlands

[21] Appl. No.: 67,742

[22] Filed: Aug. 20, 1979

[30] Foreign Application Priority Data

Aug. 22, 1978 [NL] Netherlands ..... 7808659

[51] Int. Cl.[3] ..... E01B 1/00; E01B 19/00

[52] U.S. Cl. ..... 238/2; 238/283; 238/382

[58] Field of Search ..... 238/2, 5, 6, 7, 83, 238/283, 382, 1, 37, 84; 104/1 R, 11

[56] References Cited

U.S. PATENT DOCUMENTS

| | | | |
|---|---|---|---|
| 2,068,714 | 1/1937 | Stedefeld | 238/115 X |
| 2,162,599 | 6/1939 | Austin et al. | 238/283 |
| 2,669,942 | 2/1954 | Scheuchzer | 104/11 |
| 3,587,964 | 6/1971 | Cork | 238/2 |
| 3,656,690 | 4/1972 | Hanig | 238/2 |
| 4,079,889 | 3/1978 | Halpenny | 238/84 X |

FOREIGN PATENT DOCUMENTS

| | | | |
|---|---|---|---|
| 846653 | 7/1970 | Canada | 238/283 |
| 2610727 | 9/1977 | Fed. Rep. of Germany | 238/382 |
| 52-18611 | 2/1977 | Japan | 238/382 |
| 140191 | 5/1953 | Sweden | 104/11 |

*Primary Examiner*—Randolph A. Reese
*Attorney, Agent, or Firm*—Diller, Ramik & Wight

[57] ABSTRACT

A method for restoring the vibration absorbtion of a railway track supported on a bed of ballast, a track structure obtained by applying such a method and sleepers for use with the method.

11 Claims, 9 Drawing Figures

RESTORED VIBRATION ISOLATION FOR RAILWAY TRACKS

BACKGROUND OF THE INVENTION

The invention relates to a method for improving the vibration absorbtion of a railway track supported on a bed of ballast, more especially a ballast bed lying in a tunnel, on a fly-over or on another artificial construction, said track consisting of rails supported by sleepers extending in lateral direction. A ballast bed generally has the advantage that much sound is absorbed and moreover that the sound is not reflected. If the bed is not too much settled, it takes vibrations itself which are not conducted further. A disadvantage, especially when such a ballast bed is lying on an artificial construction is that when such a ballast bed is settled after some time, the vibrations at the under surface are transmitted to the supporting part of the artificial construction.

The invention has for its aim to provide a method with which the vibration absorbtion can be approved in a simple way.

BRIEF SUMMARY OF THE INVENTION

According to the invention the track is lifted some centimeters, around the edge of the supporting surface of the sleepers the ballast above the level of said surface is removed, a plate of vibration energy absorbing material is shifted between the supporting surface of the ballast bed and the sleepers and thereafter the track is lowered again and as far is required the ballast around the sleepers is brought in the original position or there is supplied new ballast. Owing to the inserted plate of vibration energy material the vibrations can not be transmitted to the support of the track structure. The reflecting action of the ballast remains completely the same.

According to the invention one can make use of plates of vibration energy absorbing material, which at their upper surface are provided with a layer which adheres quickly to the sleeper. As soon as the plate is inserted under the sleeper and the track is lowered again, the plate will adhere immediately to the sleeper and form a unity with the sleeper.

According to the invention plates can be used of vibration energy absorbing material, which at the surface directed to the ballast are provided with a monolithic layer which resists the reaction of the ballast. The lifetime of the plate is increased strongly by this measure.

In an advantageous embodiment according to the invention cork rubber or a similar material can be used as a vibration energy absorbing material.

According to the invention the ballast can be removed at the end face of each sleeper. Then the plate of vibration energy absorbing material can be inserted under the sleeper from the end face. It is only necessary to remove a small amount of ballast, as the end face is short.

Also according to the invention on both sides of the track in the compartments between the sleepers in every other compartment the ballast can be removed at the side of the supporting surface of the sleepers directed to said compartment. In each compartment one can serve two sleepers so that the next compartment can be left.

According to the invention the space between the under surface of the sleeper and the ballast bed around the plate of vibration energy absorbing material can be filled with a soft material. In such a way it is prevented that loose parts of ballast can shift between the sleeper and the ballast bed, which could have for effect that the supporting action of the plate vibration energy absorbing material could be influenced.

For providing the soft material use can be made of soft material that in the shape of the plate form a unity with the plate of vibration energy absorbing material.

According to the invention it is also possible that said space is filled by means of injecting a plastic foam.

The invention also relates to a track structure consisting of rails supported by sleepers on a ballast bed, more especially a ballast bed lying on a fly-over, in a tunnel or on another artificial construction.

According to the invention the sleepers are supported on the ballast bed through plates consisting of a vibration energy absorbing material, more especially cork rubber.

According to the invention the plates at their under surface can be provided with a hard wearing resistant layer forming a unity with said surface, said layer being in contact with the ballast bed. Finally the invention also relates to a sleeper for use on a ballast bed having no or only a little damping properties.

According to the invention such a sleeper at its under surface is provided with a layer of vibration energy absorbing material, which at its under surface has a layer of a hard wearing resistant material forming a unity with said absorbing material.

The invention will be elucidated in the following description of some embodiments shown in the drawing.

In the drawing is:

FIG. 1 a track in a plan view,

FIG. 2 the track of FIG. 1 in a sectional view according to the line II—II, FIG. 3 a sectional view of FIG. 2 in a further phase, FIG. 4 a section according to the lines IV—IV in FIG. 1, FIG. 5 a sectional view of a track in another embodiment, FIG. 6 schematically a track in a plan view, FIG. 7 a plan view corresponding with FIG. 6, FIG. 8 an embodiment of a track in a plan view, FIG. 9 a track in another embodiment also in a plan view.

DETAILED DESCRIPTION OF THE INVENTION

Figure 1:
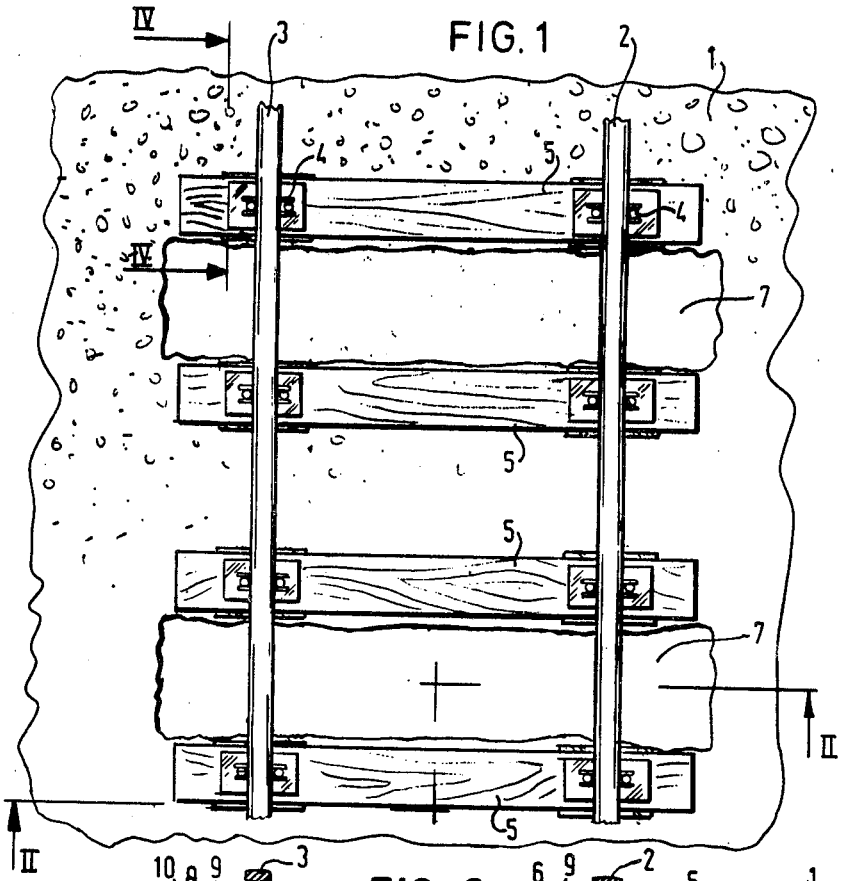
Figure 2:
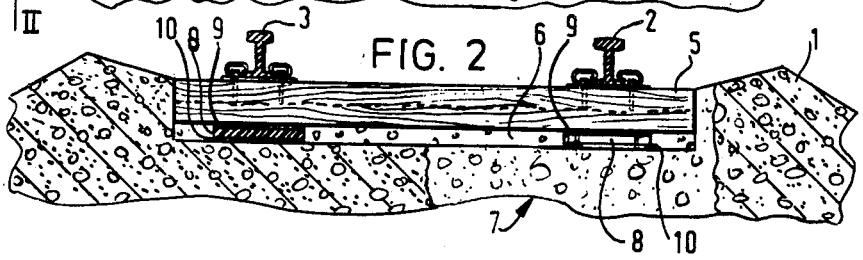

FIG. 1 shows a track lying on a ballast bed 1, consisting of rails 2 and 3, which with clamps 4 are attached to sleepers 5. The ballast bed is lying on an artificial construction, for example on the floor of a tunnel. When the ballast bed 1 has been settled too much the vibration absorbing characteristics of the ballast are significantly impaired.

According to the invention the track consisting of the rails 2 and 3 and the sleepers 5 is lifted some centimeters. Between the layers 5 and the settled ballast is then formed a space 6. Between the sleepers 5, as is indicated at 7, the ballast which is lying above the level of the supporting surface of the sleepers can be removed. The space 6 is now accessible from the side and under the sleepers can now be shifted the plates 8, said plates consisting of vibration energy absorbing material. At its upper surface the plates 8 can be provided with an adhesive layer 9 and at its under surface with a hard layer 10 which resists the influence of the ballast bed. When the track thereafter has been lowered the plates 8 adhere to the sleepers 5 and these sleepers 5 are supported by the plates 8.

Figure 3:
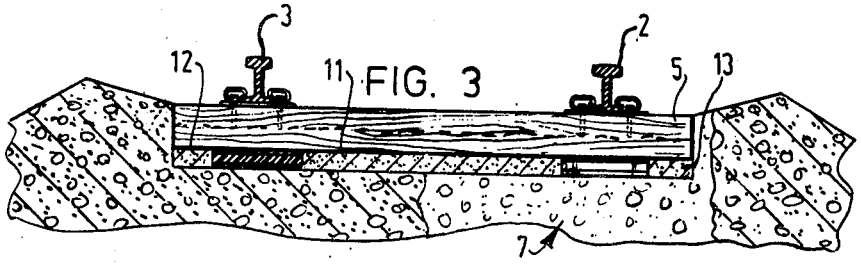
Figure 4:
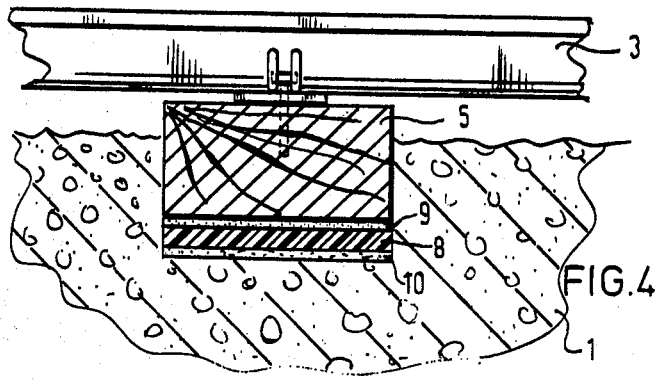
Figure 5:
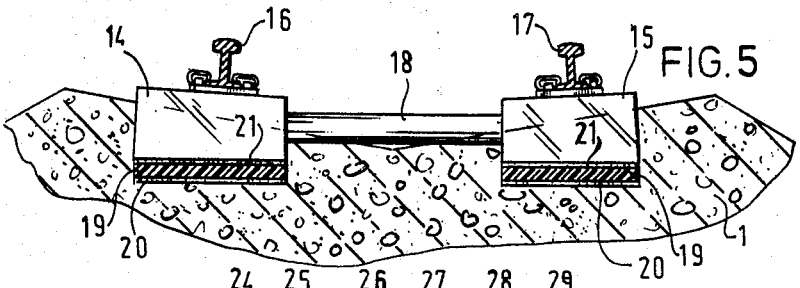

As can be seen in FIG. 3 between the plates 8 below the layers 5 can be provided a layer of a soft material 11. This layer 11 takes care that no ballast can take over the supporting action of the plates 8. Also at the outer side of the plates 8 a same layer 12 and 13 can be provided. Thereafter the ballast can be placed again at the side of the sleepers. FIG. 4 shows on a greater scale a sleeper and a plate in cross section and better illustrates the layers 8, 9, 10. FIG. 5 shows a modified form of sleeper which consists of two blocks 14 and 15 supporting the rails 16 and 17, the blocks being connected by tubes or rods 18. Here also the track can be lifted and vibration energy absorbing plates 19 can be provided between the sleeper and the ballast bed, each plate as before having the upper wearing resistant layer 20, an upper surface adhesive layer 21 and the intermediate layer 19 of cushioning material.

Figure 6:
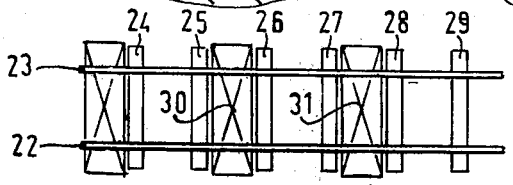

FIGS. 6, 7, 8 and 9 show a track in plan view in which the rails 22 and 23 are supported by sleepers 24, 25, 26, 27, 28 and 29. FIG. 6 illustrates how the ballast can be removed in order to make the spaces below all of the sleepers accessable. When for example said ballast is removed at 30 and 31 over the whole length of the sleepers, it is possible to slip the plates of elastic material under the sleepers 25, 26 from the compartment 30 whereas the plates can be slipped below the sleepers 27, 28 from the compartment 31.

Figure 7:
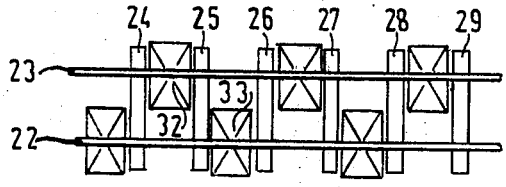

FIG. 7 shows an alternate manner of inserting the plates, in which the ballast is removed at 32 from between the sleepers 24 and 25 and from between the sleepers 25 and 26 at 33. It is then possible to insert a plate below each of the sleepers 24 and 25 from the compartment 32 whereas a plate can be inserted beneath the other end of the sleeper 25 from the compartment 33, and so on for the entire track section. The material 11, as in FIG. 3, can for example be provided by injecting.

Figure 8:
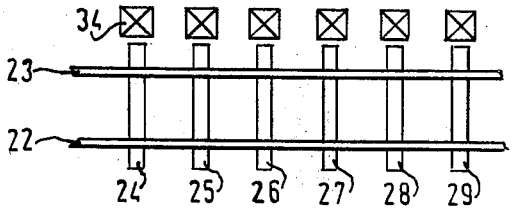

FIG. 8 shows a further alternative for inserting the plates. The ballast at one of the end faces of the sleepers 24 to 29 is removed as at 34. Then the plates of vibration energy absorbing material for each sleeper can be inserted from the corresponding compartment.

Figure 9:
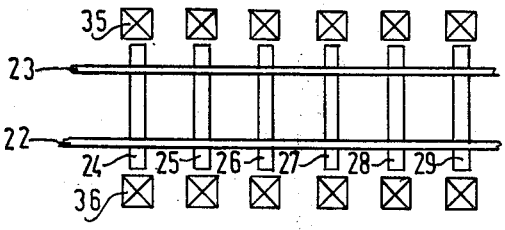

FIG. 9 shows a further embodiment in which the ballast is removed at both ends of the sleepers 24 to 29. Then in contrast to FIG. 8, the sleeper 24 for example can be provided at one end with the supporting plate from the compartment 35 and for the other half from the compartment 36. Although there is more work required in removing the ballast than in FIG. 8, the shifting of the plates under the sleepers is simpler, particularly when the soft layer 11 of FIG. 3 is provided by injecting.

Owing to the method according to the invention the vibration absorbing characteristics of the ballast bed is completely restored and the sound reflecting working of the ballast bed remains completely the same.

What I claim is:

1. The method of restoring the vibration absorbing properties of a compacted railway ballast bed, which comprises the steps of:

(a) locally elevating a section of track and sleepers to provide spaces defined between the bottom supporting surfaces of the sleepers and those surfaces of the compacted ballast which previously supported such sleepers;

(b) inserting two plates of vibration-absorbing material within said spaces beneath each sleeper, the plates supporting only localized areas of the sleeper; and then (c) lowering the section of track such that it is supported on the compacted ballast only through the medium of said plates;

(d) filling the remainder of the space beneath each sleeper with soft material to inhibit the penetration of ballast beneath the sleepers.

2. The method as defined in claim 1 including the steps of removing ballast from the top of said bed to provide easy access to the spaces provided in step (a) and, subsequent to step (d), replacing ballast on the top of said bed around said sleepers.

3. The method as defined in claim 2 wherein ballast is removed only between sleepers.

4. The method as defined in claim 2 wherein ballast is removed only at the ends of the sleepers.

5. The method as defined in any one of claims 1 to 4 wherein each plate inserted in step (b) is provided with an adhesive top layer whereby as a result of step (c) each plate is adhesively attached to its sleeper.

6. The method as defined in claim 5 wherein each plate is also provided with a wear-resistant bottom layer which engages the ballast bed.

7. The method as defined in any one of claims 1 to 4 wherein each plate inserted in step (b) is provided with a wear resistant bottom layer which engages the ballast bed.

8. A railway track structure which comprises a support such as a bridge, a bed of particulate ballast material on said support and which has become compacted sufficiently as to have lost a significant degree of its initial vibration-absorbing properties, a pair of rails and a plurality of sleepers supporting said rails, resilient means interposed between said sleepers and said compacted bed at least at two localized areas of each sleeper for absorbing vibrations transmitted from said rails sufficiently that the vibration isolation between the track and support initially provided by the ballast bed is restored, and a layer of foamed material filling that space between each sleeper and the ballast bed which is not occupied by said resilient means.

9. A railway track structure as defined in claim 8 wherein said resilient means comprises a pair of plates for each sleeper, each plate having an adhesive top layer whereby it is attached to its sleeper, a wear-resistant bottom layer engaging the ballast bed and an intermediate layer of resilient material.

10. A railway track structure as defined in claim 8 wherein said resilient means comprises a pair of plates for each sleeper, each plate having an adhesive top layer whereby it is attached to its sleeper.

11. A railway track structure as defined in claim 8 wherein said resilient means comprises a pair of plates for each sleeper, each plate having a wear-resistant bottom layer engaging the ballast bed.

* * * * *